US010609485B2

(12) United States Patent
Nawfal et al.

(10) Patent No.: US 10,609,485 B2
(45) Date of Patent: Mar. 31, 2020

(54) SYSTEM AND METHOD FOR PERFORMING PANNING FOR AN ARBITRARY LOUDSPEAKER SETUP

(71) Applicant: Apple Inc., Cupertino, CA (US)

(72) Inventors: Ismael Nawfal, Los Angeles, CA (US); Symeon Delikaris Manias, Helsinki (FI); Joshua D. Atkins, Los Angeles, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/000,281

(22) Filed: Jun. 5, 2018

(65) Prior Publication Data

US 2019/0104364 A1 Apr. 4, 2019

Related U.S. Application Data

(60) Provisional application No. 62/566,245, filed on Sep. 29, 2017.

(51) Int. Cl.
*H04S 5/00* (2006.01)
*H04S 3/00* (2006.01)
(Continued)

(52) U.S. Cl.
CPC ..... *H04R 5/02* (2013.01); *H04S 3/00* (2013.01); *H04S 5/005* (2013.01); *H04S 7/302* (2013.01); *H04S 7/308* (2013.01); *H04S 2400/13* (2013.01)

(58) Field of Classification Search
CPC . H04S 5/005; H04S 3/00; H04S 7/302; H04S 7/308; H04S 2400/13; H04S 3/002; H04S 5/02; H03G 3/01; H04R 5/02
(Continued)

(56) References Cited

U.S. PATENT DOCUMENTS 9,154,877 B2 10/2015 Kim et al.
9,681,249 B2 6/2017 Yamamoto et al.
(Continued)

FOREIGN PATENT DOCUMENTS

CN 106446532 2/2017

OTHER PUBLICATIONS

Fabio Kaiser, A Hybrid Approach for Three-Dimensional Sound spatialization, seminar, May 3, 2011, 17 pages Algorithmen in Akustik and Computermusik 2, SE, Graz, Austria.
(Continued)

*Primary Examiner* — Vivian C Chin
*Assistant Examiner* — Ubachukwu A Odunukwe
(74) *Attorney, Agent, or Firm* — Womble Bond Dickinson (US) LLP

(57) ABSTRACT

Placement of one or two placed virtual loudspeakers within a loudspeaker setup that includes a real loudspeakers is determined and vector base amplitude panning (VBAP) gains including the gains of the real loudspeakers and placed one or two virtual loudspeakers are also then determined. Gains of one or two placed virtual loudspeakers are redistributed to the real loudspeakers to ensure preservation of total energy. Real loudspeakers in the loudspeaker setup have redistributed gains of one or two placed virtual loudspeakers. Loudspeaker outputs are generated and transmitted to the real loudspeakers to be played back. When received audio content is ambisonics content, a predetermined grid is generated and HOA content is projected to the grid. Other aspects are also described.

17 Claims, 6 Drawing Sheets

(51) Int. Cl.
*H04R 5/02* (2006.01)
*H04S 7/00* (2006.01)

(58) Field of Classification Search
USPC ..... 381/77, 20, 17, 18, 307
See application file for complete search history.

(56) References Cited

U.S. PATENT DOCUMENTS

| | | | | |
|---|---|---|---|---|
| 9,736,609 | B2 | 8/2017 | Morrell et al. | |
| 2011/0316967 | A1* | 12/2011 | Etter | H04N 7/142 348/14.16 |
| 2014/0016802 | A1* | 1/2014 | Sen | H04S 3/002 381/307 |
| 2016/0073213 | A1* | 3/2016 | Yamamoto | H04S 5/005 381/18 |

OTHER PUBLICATIONS

Sebastian Moreau, Jerome Daniel, Stephanie Bertet, 3D Sound Field Recording with Higher Order Ambisonics —Objective Measurements and Validation of a 4$^{th}$ Order Spherical Microphone, 24 pages, Audio Engineering Society Convention Paper, 120$^{th}$ Convention, Paris, France.

Franz Zotter, Matthias Frank, All-round Ambisonic Panning and decoding, 14 pages, J. Audio Eng. Soc., vol. 60, No. 10, Oct. 2012, New York, New York.

Ville Pulkki, Compensating Displacement of Amplitude-Panned Virtual Sources, AES 22nd International Conference on Virtual, Synthetic and Entertainment Audio, 10 pages, *Laboratory of Acoustics and Audio Signal Processing*, Finland.

Jurgen Herre, Johannes Hilpert, Achim Kuntz, Jan Plogsties, MPEG-H Audio—The New Standard for Universal Spatial / 3D Audio Coding, International Audio Laboratories Erlangen, Germany, 12 pages, Fraunhofer IIS, Erlangen, Germany.

Ville Pulkki, Spatial Sound Generation and Perception by Amplitude Panning Techniques, Helsinki University of Technology Laboratory of Acoustics and Audio Signal Processing, Dissertation, Aug. 3, 2001, Espoo 2001 Report 62, 59 pages, Helsinki University of Technology, Finland.

Ville Pulkki, Virtual Sound Source Positioning Using Vector Base Amplitude Panning, 11 pages, J. Audio Eng. Soc., vol. 45, No. 6, Jun. 1997 , New York.

Virtual Sound Source Positioning Using Vector Base Amplitude Panning, by V Pulkki; Audio Engineering Society, Inc. Jun. 1997; pp. 456-466—2001 <http://lib.tkk.fi/Diss/2001/isbn9512255324/article1>.

Compensating Displacement of Amplitude-panned Virtual Sources, by V Pulkki; Laboratory of Acoustics and Audio Signal Processing; AES 22nd Annual conference on Virtual, Synthetic and Entertainment Audio; pp. 1-10—2002.

* cited by examiner

SYSTEM AND METHOD FOR PERFORMING PANNING FOR AN ARBITRARY LOUDSPEAKER SETUP

This application claims the benefit pursuant to 35 U.S.C. 119(e) of U.S. Provisional Application No. 62/566,245, filed Sep. 29, 2017, which application is specifically incorporated herein, in its entirety, by reference.

FIELD

Aspects in the disclosure here relate generally to a system and method for performing panning for an arbitrary loudspeaker setup.

BACKGROUND

Ambisonics is a surround sound technique based on spherical Fourier expansion of the sound field. Ambisonics is used to represent a 3D sound field for scene-based audio. This representation can be performed using first order Ambisonics (FOA) or higher order Ambisonics (HOA.) Within the context of this disclosure, the term Ambisonics or ambisonic content refers to any order of Ambisonics of ambisonic content. A sound source can either be encoded in an ambisonic format, or it may be recorded via a special microphone. Such a representation of the sound field may then be transmitted to an end user machine where it is decoded for playback. Conventional ambisonic decoders require an optimally placed fixed loudspeaker setup which means that the decoders cannot perform well with arbitrary loudspeaker setups.

Panning is the distribution of a sound signal into a new stereo or multi-channel sound field, as determined by a pan control setting that may for example be in the range from a hard left position to a hard right position. Existing panning techniques have some limitations. For example, the existing panning techniques do not perform well when loudspeakers are not distributed in a way that fully encompasses the listening position (e.g., horizontal loudspeaker setups, frontal only setups, etc.). Existing panning techniques only perform well when the panning trajectory is within the span of the loudspeakers. Some loudspeaker setups impose limitations on more complex panning trajectories, such as when trying to pan a sound source in 3-dimensional space while the loudspeaker setup spans only a 2-dimensional space.

SUMMARY

Generally, aspects of the disclosure here relate to a system and method for performing panning for an arbitrary loudspeaker setup. One aspect is to modify the vector base amplitude panning (VBAP) technique to improve the panning behavior of sound sources in arbitrary loudspeaker setups by optimizing the placement of virtual loudspeakers in the loudspeaker setup. Further, in some aspects, contrary to existing techniques, the energy of the intended sound field is preserved.

In one aspect, the method of performing panning for an arbitrary loudspeaker setup starts by determining a placement of one or two virtual loudspeakers within the loudspeaker setup which includes a plurality of real loudspeakers. When the loudspeaker setup is a 2-channel setup, locations of the two virtual loudspeakers are based on a center of a line formed by locations of two real loudspeakers included in the loudspeaker setup and a listening position. When the loudspeaker setup is a 2-dimensional (2D) setup including more than two real loudspeakers, the locations of the two virtual loudspeakers are based on a centroid of a polygon formed by locations of real loudspeakers and the listening position. When the loudspeaker setup is a 3-dimensional (3D) setup, the location of the one virtual loudspeaker is based on a center of gravity of a polyhedron formed by the positions of the real loudspeakers. The VBAP gains are then determined. The VBAP gains may include gains of the real loudspeakers and the one or two virtual loudspeakers. Loudspeaker outputs (signals that drive loudspeakers) are then generated and transmitted to the real loudspeakers in the loudspeaker setup to be played back.

In another aspect, a method of performing panning for an arbitrary loudspeaker setup starts by determining a placement of one or two virtual loudspeakers within the loudspeaker setup which includes a number of real loudspeakers. VBAP gains are then determined. The VBAP gains may include gains of the real loudspeakers and the one or two virtual loudspeakers. The gains of the one or two virtual loudspeakers to the real loudspeakers are then redistributed to ensure preservation of total energy. In one aspect, redistributing gains includes determining a location of a panned sound source, determining a quadratic formula based on the location of the panned sound source, and solving the quadratic formula to obtain a redistribution of gains needed to ensure preservation of total energy. The loudspeaker outputs are then generated and transmitted to the real loudspeakers in the loudspeaker setup to be played back.

In one aspect, the placement of one or two placed virtual loudspeakers within the arbitrary loudspeaker setup (that also includes a number of real loudspeakers) is determined so as to produce a 3D shape or convex hull. This allows the method to then calculate the VBAP gains, that include gains of the real loudspeakers and of the placed one or two virtual loudspeakers. Gains of the one or two placed virtual loudspeakers are redistributed to the real loudspeakers in a way that ensures preservation of total energy of a sound field (e.g., an intended sound field, or the recorded sound field of the audio content that is to be output through the loudspeakers which may be ambisonic content.) Loudspeaker outputs (loudspeaker driver signals) are generated based on that redistribution, and transmitted to the real loudspeakers in the loudspeaker setup to be played back. In other words, the gains assigned to the real loudspeakers in the loudspeaker setup now have the redistributed gains of the one or two placed virtual loudspeakers.

In yet another aspect, a system for performing panning for an arbitrary loudspeaker setup comprises a storage storing instructions; and a processor coupled to the storage. When the processor executes the instructions, the processor receives audio content, for playback via a number of real loudspeakers in the loudspeaker setup, determines a placement of one or two virtual loudspeakers within the loudspeaker setup, determines VBAP gains, redistributes gains of the one or two virtual loudspeakers to the real loudspeakers to ensure preservation of total energy, and generates and transmits the loudspeaker outputs (based on the redistributed gains) to be played back by the real loudspeakers.

In one particular aspect, a method of performing panning for an arbitrary loudspeaker setup starts by receiving audio content for playback through a number of real loudspeakers in a given loudspeaker setup, and determining whether the audio content is ambisonic content (e.g., Higher Order Ambisonics, HOA.) When the audio content is ambisonic content, a predetermined placement of points on a sphere or on a grid is generated, wherein the placement of points may depend on the order of the ambisonic content or its resolution. This may also be referred to as a projection grid. The ambisonic content may then be projected onto this grid, thereby producing a separate audio signal for each point. This result is then passed to the The above summary does not include an exhaustive list of all aspects of the present disclosure. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The aspects of the invention are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect. In the drawings.

DETAILED DESCRIPTION

In the following description, numerous specific details are set forth. However, it is understood that aspects of the disclosure may be practiced without these specific details. In other instances, well-known circuits, structures, and techniques have not been shown to avoid obscuring the understanding of this description.

In the description, certain terminology is used to describe the various aspects of the disclosure here. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

Figure 1:
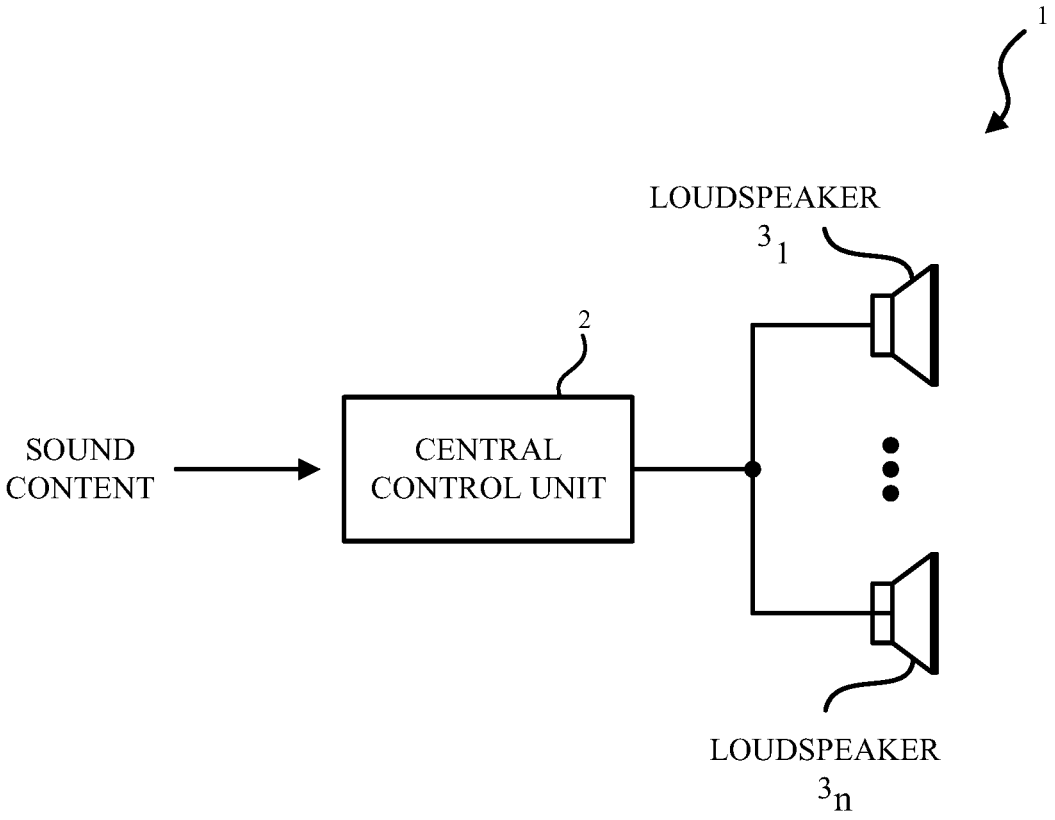
FIG. 1 illustrates a block diagram of a system for performing panning for an arbitrary loudspeaker setup.

FIG. 1 illustrates a block diagram of a system 1 for performing panning for an arbitrary loudspeaker setup according to one aspect of the disclosure here. The system 1 includes a central control unit 2, and (real) loudspeakers $\mathbf{3}_1$-$\mathbf{3}_n$ (n>1) that are in an arbitrary loudspeaker setup. The arbitrary loudspeaker setups may include, for example, 2-channel setups including two loudspeakers $\mathbf{3}_1$, $\mathbf{3}_2$ (see e.g., FIG. 3A), 2-dimensional (2D) setups that include more than two loudspeakers $\mathbf{3}_1$-$\mathbf{3}_{n+1}$ (n>1) (see e.g., FIG. 3B), and 3-dimensional (3D) setups (see e.g., FIG. 3C).

While not shown each of the real loudspeakers $\mathbf{3}_1$-$\mathbf{3}n$ may be integrated in a separate loudspeaker cabinet (also referred to as an enclosure) that includes a loudspeaker driver, a power audio amplifier and digital to analog converter (DAC). The loudspeaker driver may be an electrodynamic driver. The power audio amplifier may have an output coupled to the drive signal input of the loudspeaker driver and may receive an analog input from a DAC. The DAC and the amplifier may be separate blocks or may have electronic circuit components that are combined. The DAC may receive its input digital audio signal (also referred to here as a loudspeaker output or a loudspeaker driver signal) through an audio signal communication link (wired or wireless) to the central control unit 2. Sound content (or audio content), in the form of digital signals for example, is received and processed by the central control unit 2 to produce or generate loudspeaker output signals which are transmitted to the loudspeakers $\mathbf{3}_1$-$\mathbf{3}_n$ to be played back (converted into sound).

Figure 2:
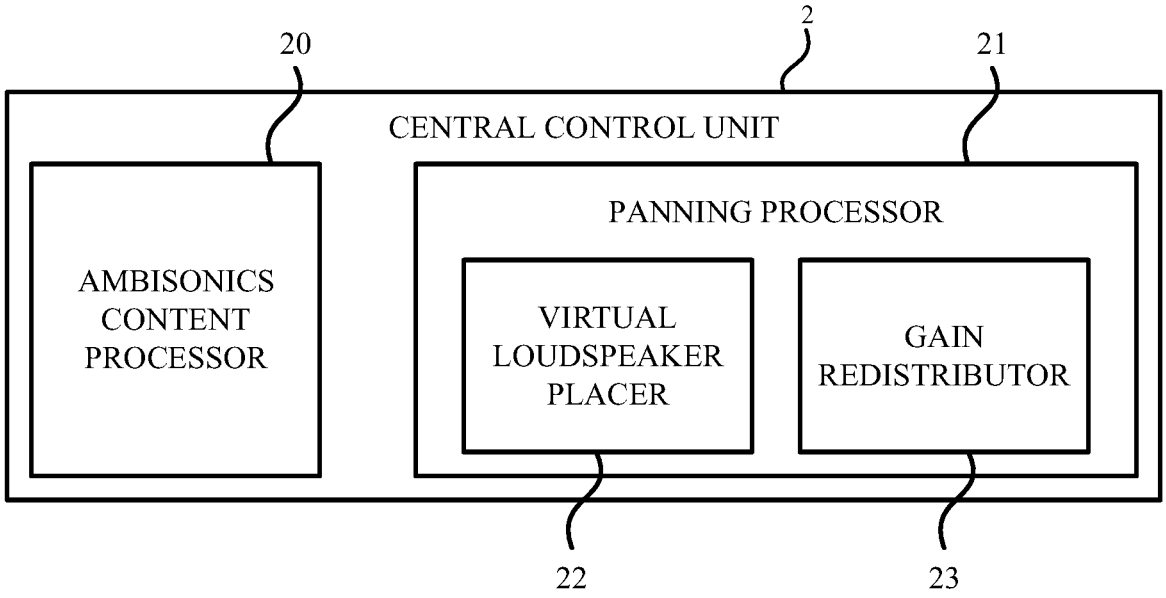
FIG. 2 illustrates an example of the details of the central control unit of the system in FIG. 1 for performing panning for an arbitrary loudspeaker setup.

FIG. 2 illustrates details of an example of the central control unit 2 for performing panning for an arbitrary loudspeaker setup in accordance with one aspect of the disclosure. The central control unit 2 may include a processor, such as a microprocessor, a microcontroller, a digital signal processor, or a central processing unit, and other needed integrated circuits such as glue logic. The term "processor" may refer to a device having two or more processing units or elements, e.g. a CPU with multiple processing cores. The processor of the central control unit 2 may be used to control the operations of central control processor 2 by executing software instructions or code stored in a storage (not shown in FIG. 2) included in the central control unit 2. The storage may include one or more different types of storage such as hard disk drive storage, nonvolatile memory, and volatile memory such as dynamic random access memory. In some aspects, the storage may be on-board the central control unit 2 or may be a separate component of system 1 (FIG. 1). In some cases, a particular function as described below may be implemented as two or more pieces of software in the storage that are being executed by different hardware units of a processor. As shown in FIG. 2, central control unit 2 includes an ambisonic content processor 20 and a panning processor 21 that includes a virtual loudspeaker placer 22 and a gain redistributor 23.

The content processor 20 receives the audio content for playback by the loudspeakers 3_1 to **3_*n* and determines whether the audio content is ambisonic content. When the audio content is ambisonic content, the content processor 20 generates a predetermined placement of points or a grid and projects the ambisonic content to the grid to generate projected ambisonic content. In one aspect, the content processor 20** may include an ambisonic decoding matrix to decode the ambisonic content.

In one aspect, the ambisonic content processor 20 generates the projection grid on a surface of a sphere. The points may be uniformly distributed on the surface of the sphere, e.g., in accordance with a spherical t-design. Thus, the ambisonic content processor 20 generates the projection grid using a uniform or almost uniform arrangement of points on the surface of a sphere. More generally, the ambisonic content processor 20 generates an array in which the positions are defined as points on the surface of a sphere that are distributed in a uniform or almost uniform manner. Such arrangements can be based on, but not limited to, spherical t-designs, and alternative arrangements can be based on sphere packing and sphere covering problem solutions, using the vertices of a regular polyhedral, using minimum energy criteria, or based or geodesic spheres.

The ambisonic content processor 20 generates the projected ambisonic content and sends the projected ambisonic content to the panning processor 21. In one aspect, when the content processor 20 determines that the audio content is not ambisonic content, the content processor 20 performs no processing on the audio content and transmits the audio content "as is" to the panning processor 21.

By combining the ambisonic content processor 20 and the panning processor 21, when ambisonic content is received, ambisonic decoding may be automated for arbitrary loudspeaker setups, while preserving the total energy of the original ambisonic content or that of the intended sound scene as described below in detail.

As shown in FIG. 2, the panning processor 21 includes a virtual loudspeaker placer 21 and a gain redistributor 23. The virtual loudspeaker placer 22 determines a placement of one or more placed virtual loudspeakers within the original, arbitrary loudspeaker setup. It is noted that the one or more placed virtual loudspeakers are different and separate from the projection grid that was generated by the ambisonic content processor 20. The virtual loudspeaker placer 22 aims to place the one or more placed virtual loudspeakers in appropriate locations around a listener position (e.g., user listening to the audio content being played back) in the original arbitrary loudspeaker setup so that virtual sources may be panned in any direction. The location or locations of the one or more placed virtual loudspeakers are determined based on the positions of the (real) loudspeakers $\mathbf{3}_1$-$\mathbf{3}_n$ in FIG. 1. In one aspect, the one or more placed virtual loudspeakers includes only one or two placed virtual loudspeakers.

Figure 3A:
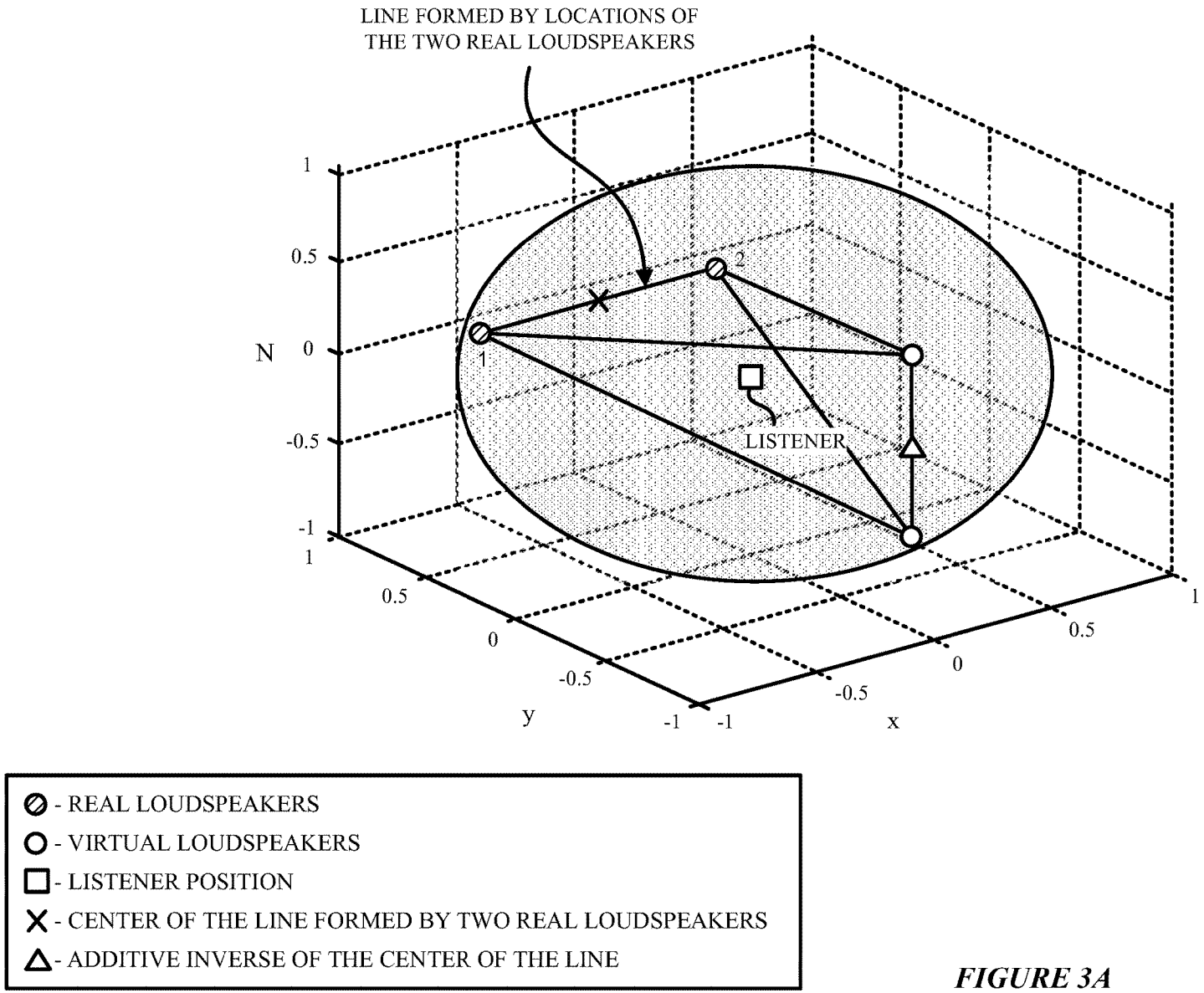
FIGS. 3A-3C illustrates exemplary loudspeaker setups with virtual loudspeakers including a 2-channel setup (FIG. 3A), a 2-dimensional (2D) setup with more than two real loudspeakers (FIG. 3B), and a 3-dimensional (3D) setup (FIG. 3C).
Figure 3B:
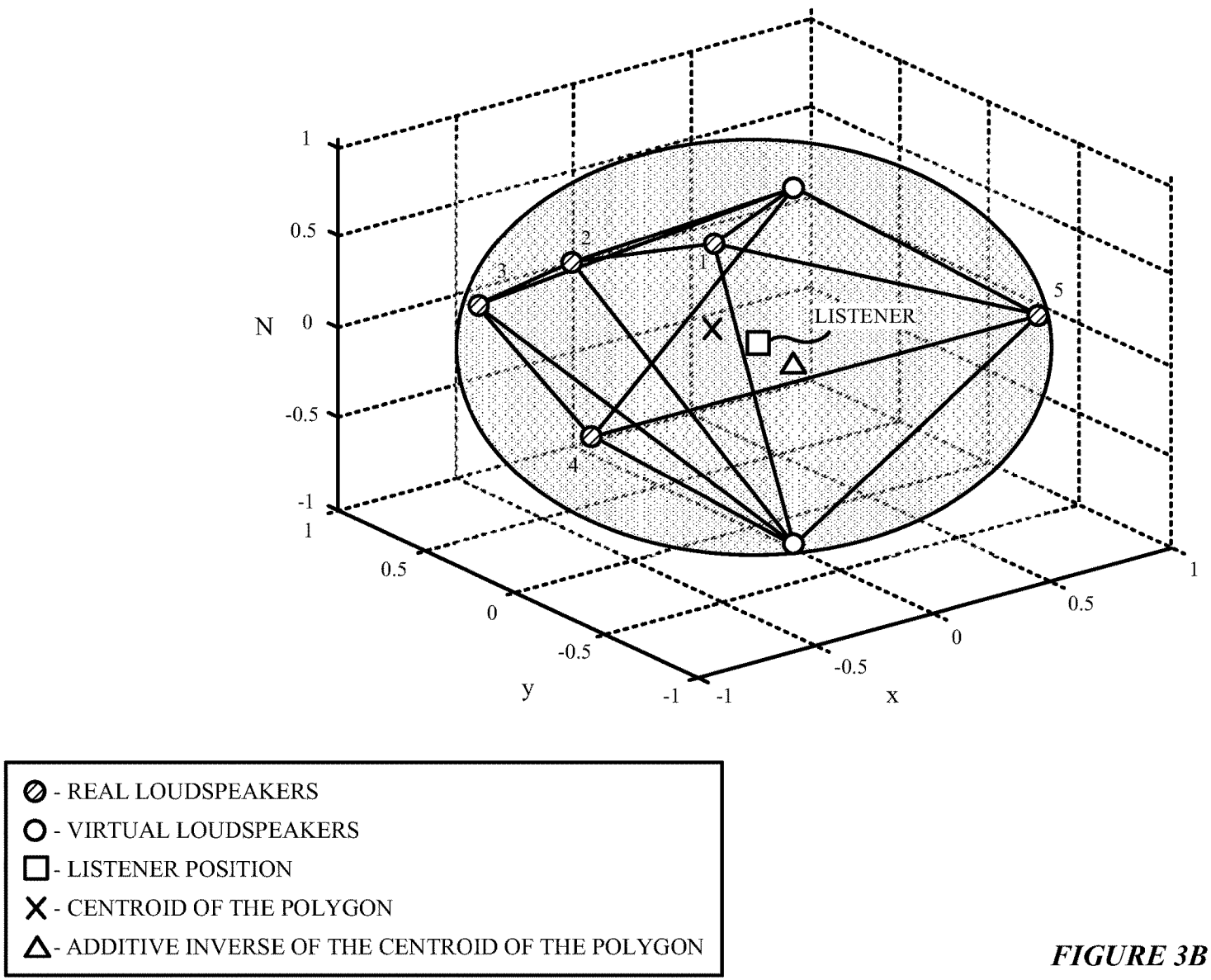
Figure 3C:
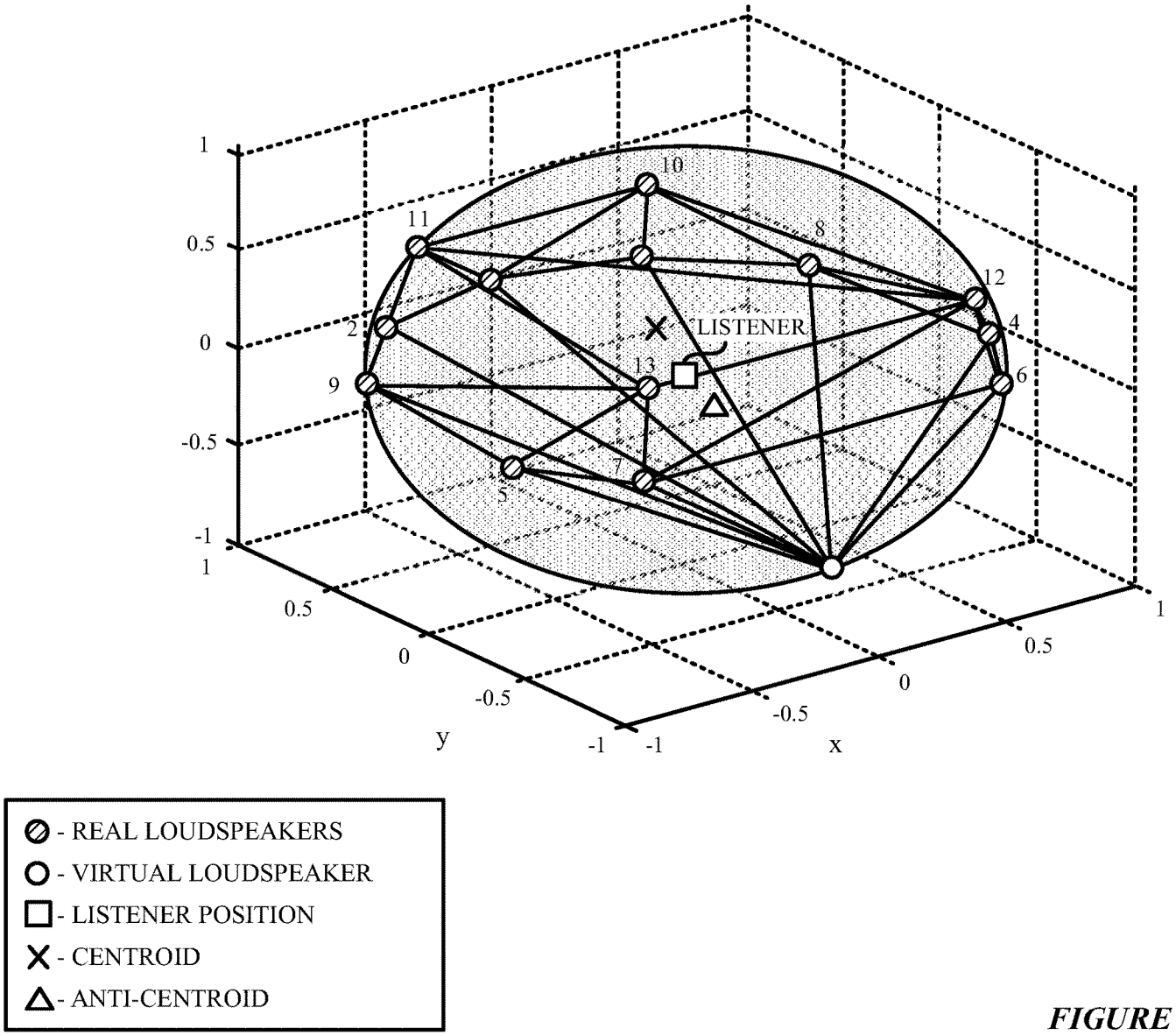

Referring to FIGS. 3A-3C, these show exemplary loudspeaker setups with placed virtual loudspeakers, including a 2-channel setup (FIG. 3A), a 2-dimensional (2D) setup with more than two real loudspeakers (FIG. 3B), and a 3-dimensional (3D) setup (FIG. 3C) according to aspects of the disclosure here. In FIGS. 3A-3C, the black dots represent the positions of the real loudspeakers, the white dots represent the location of the one or two placed virtual loudspeakers, and square represents the listener position.

In FIG. 3A, a loudspeaker setup that is a 2-channel setup (e.g., stereophonic setups) is illustrated. In this aspect, the locations of the two placed virtual loudspeakers are based on a center of a line formed by locations of two real loudspeakers included in the loudspeaker setup and a listening position. More specifically, in FIG. 3A, to position the two placed virtual loudspeakers (shown as white circles), the virtual loudspeaker placer 22 starts by determining the center of the line formed by the locations of the two real loudspeakers in the loudspeaker setup. This center of the line is illustrated in FIG. 3A as an X. The virtual loudspeaker placer 22 then determines an additive inverse of the center of the line formed by the locations of the two real loudspeakers. The additive inverse of the center of the line is illustrated in FIG. 3A as a triangle Δ. The virtual loudspeaker placer 22 then determines a line orthogonal to a plane formed by the locations of the two real loudspeakers and the listening position, which line also goes through the additive inverse, and determines intersection points between the line orthogonal to the plane and a unit sphere centered (shown as a circle in FIG. 3A) at the listening position. As shown in FIG. 3A, the intersection points are the placement of the two virtual loudspeakers (shown as white circles), respectively.

In FIG. 3B, a 2-dimensional (2D) setup with more than two real loudspeakers is illustrated. FIG. 3B illustrates specifically a 5-channel loudspeaker setup. In the 2D setup with more than two real loudspeakers, the locations of the two placed virtual loudspeakers are based on a centroid of a polygon formed by locations of real loudspeakers and the listening position. More specifically, in FIG. 3B, to position the two placed virtual loudspeakers (shown as white circles), the virtual loudspeaker placer 22 starts by forming the polygon with locations of the more than two real loudspeakers in the loudspeaker setup. In one aspect, when the polygon does not include the listening position, the polygon is modified to include the listening position. The virtual loudspeaker placer 22 then determines the centroid of the polygon which is shown in FIG. 3B as an X. The virtual loudspeaker placer 22 then determines an additive inverse of the centroid of the polygon which is shown in FIG. 3B as a triangle Δ and determines a line orthogonal to the polygon plane that passes through the additive inverse. The virtual loudspeaker placer 22 then determines intersection points between the line and a unit sphere (shown as a circle in FIG. 3B) centered at the listening position, wherein the intersection points are the placement of two virtual loudspeakers, respectively.

In FIG. 3C, a 3-dimensional (3D) setup including more than two real loudspeakers is illustrated. FIG. 3C specifically illustrates a 13-channel loudspeaker setup. When the loudspeaker setup is a 3-dimensional (3D) setup, the location of the one placed virtual loudspeaker is based on a center of gravity of a polyhedron formed by the positions of the real loudspeakers. More specifically, in FIG. 3C, to position the virtual loudspeaker (shown as a white circle), the virtual loudspeaker placer 22 starts by forming the polyhedron with locations of the real loudspeakers in the loudspeaker setup and determining a centroid which is the center of mass of the polyhedron. The centroid is shown in FIG. 3C as an X. The virtual loudspeaker placer 22 then determines an anti-centroid which is an additive inverse of the centroid. The anti-centroid is shown in FIG. 3C as a triangle Δ. When the virtual loudspeaker placer 22 establishes that the centroid is at an origin, the virtual loudspeaker placer 22 determines that no placement of the one or two placed virtual loudspeakers is needed in the 3D loudspeaker setup. However, when the virtual loudspeaker placer 22 establishes that the centroid is not at an origin, the virtual loudspeaker placer 22 determines a line that includes the centroid and the anti-centroid and determines intersection points of the line and a unit sphere (shown as a circle in FIG. 3C) centered at the listening point. The virtual loudspeaker placer 22 sets the placement of the one placed virtual loudspeaker (shown as white circle in FIG. 3C) as the one of the intersection points having the smallest distance to the anti-centroid.

In some aspects, using the methods described with reference to FIGS. 3A-3C, the virtual loudspeaker placer 22 may position the one or two placed virtual loudspeakers outside of the triangulation of a loudspeaker setup (e.g., outside of the active triangle that is defined by two real loudspeakers and the listening position).

Once the one or two placed virtual loudspeakers are added to the loudspeaker setup, panning gains are calculated for sources in any direction, utilizing both the real and the virtual loudspeakers in the loudspeaker setup. Referring back to FIG. 2, the gain redistributor 23 determines the VBAP gains which include gains of the real loudspeakers $3_1$-$3_n$ and the placed one or two virtual loudspeakers. VBAP is an algorithm that provides amplitude panning gains using a vector basis and may be utilized to pan multiple virtual sources in 2D or 3D multichannel loudspeaker setups using, for example, pairs or triplets of loudspeakers.

The gain redistributor 23 then redistributes the gains of the one or two virtual loudspeakers to the gains of the real loudspeakers in a way that ensures preservation of total energy. By reassigning the gains that are assigned to the placed one or two virtual loudspeakers to the real loudspeakers, the gain redistributor 23 may also reduce panning artifacts. Depending on the location of the panned sound source, an appropriate quadratic equation is determined (e.g., as given using the table below) and solved in order to ensure preservation of energy and to further reduce panning error. To reassign the gains of the one or two virtual loudspeakers, the gain redistributor 23 determines a location of a panned sound source, determines a quadratic formula based on the location of the panned sound source, and solves the quadratic formula to obtain a redistribution of gains needed to ensure preservation of total energy.

In one aspect, the gain redistributor 23 uses the quadratic formulas based on the location of the panned source in the following Table. In the quadratic formulas, N is the number of total loudspeakers in the loudspeaker system, which includes the real loudspeakers and the virtual loudspeakers; $g_1$, $g_2$ are real loudspeakers gains and $g_i$, $g_j$ are virtual loudspeaker gains that were calculated by the gain redistributor 23 when the gain redistributor determined the VBAP gains of the one or two placed virtual loudspeakers (before redistribution of the gains). Using the quadratic formula, solving for scalar x, allows the redistribution of gains needed to ensure preservation of total energy.

| LOCATION OF PANNED SOURCE | QUADRATIC FORMULAS |
|---|---|
| At a position of a virtual loudspeaker | $N(g_i x)^2 = 1$ |
| At a position formed by a line between two virtual loudspeakers | $(g_i x + g_j x)^2 + N(g_i x)^2 + N(g_j x)^2 = 1$ |
| At a position formed by a line between one real loudspeaker and one virtual loudspeaker | $(g_1 + g_i x)^2 + (N - 1)(g_i x)^2 = 1$ |
| At a position inside a triangle formed by one real loudspeaker and two virtual loudspeakers | $(g_1 + g_i x + g_j x)^2 + (N - 1)(g_i x)^2 + (N - 1)(g_j x)^2 = 1$ |
| At a position inside a triangle formed by two real loudspeakers and one virtual loudspeaker | $(g_1 + g_i x)^2 + (g_2 + g_i x)^2 + (N - 2)(g_i x)^2 = 1$ |

The panning processor 21 then generates and transmits loudspeaker outputs (loudspeaker driver signals) to the real loudspeakers $3_1$-$3_n$ in FIG. 1 to be played back. In this aspect, the real loudspeakers $3_1$-$3_n$ are assigned the redistributed gains of the one or two placed virtual loudspeakers. When the audio is ambisonic content, the real loudspeakers $3_1$-$3_n$ can thus playback the loudspeaker outputs that include the projected ambisonic content.

The following aspects may be described as a process, which may be depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 4:
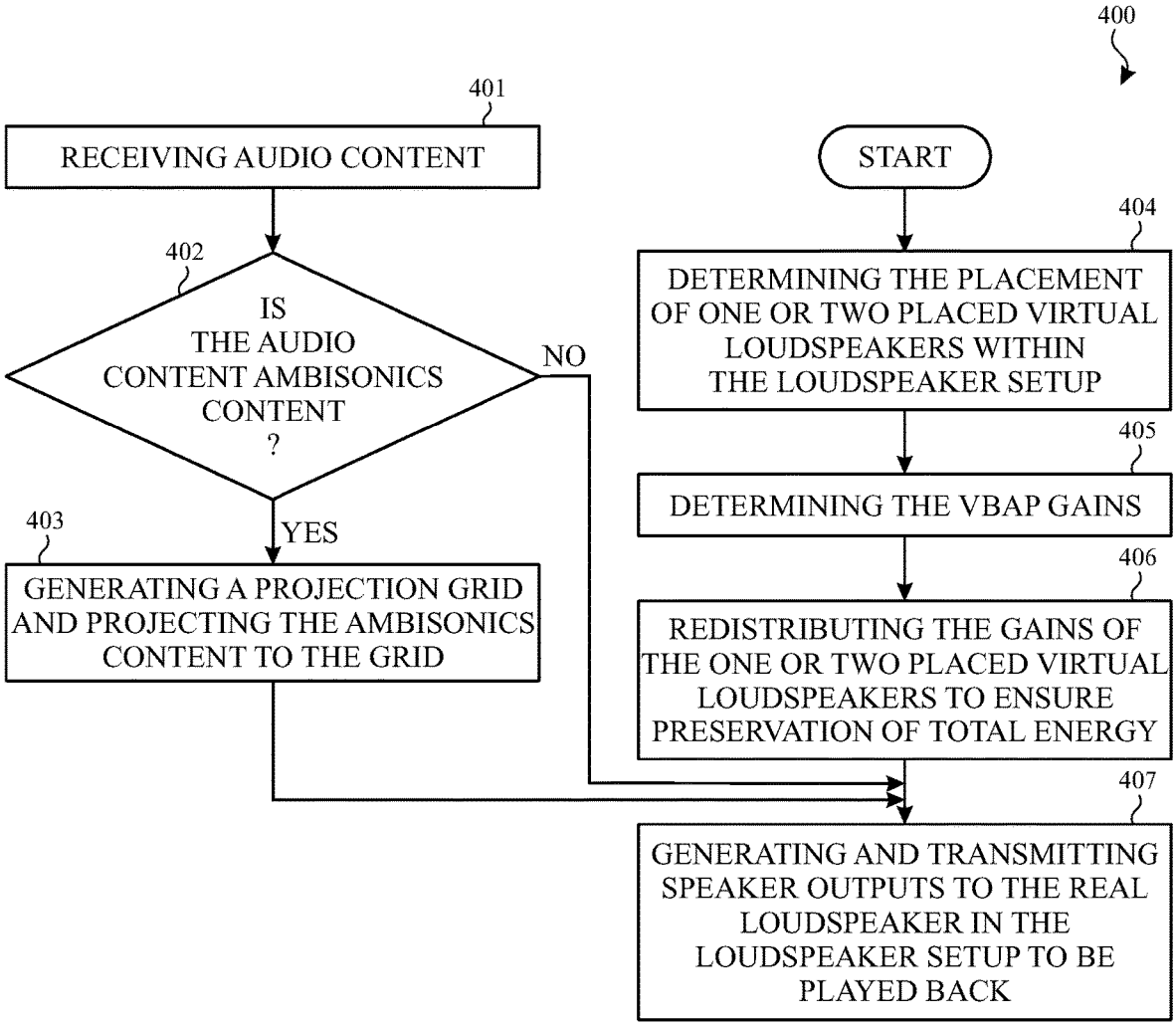
FIG. 4 illustrates a flow diagram of an example method for performing panning for an arbitrary loudspeaker setup.

FIG. 4 illustrates a flow diagram of an example method 400 for performing panning for an arbitrary loudspeaker setup according to one aspect.

The method 400 starts with the central control unit 2 receiving audio content for playback via a plurality of real loudspeakers $3_1$-$3_n$ in the loudspeaker setup (Block 401). At Block 402, the content processor 20 included in the central control unit 2 determines whether the audio content is ambisonic content. If the audio content is ambisonic content, at Block 403, the content processor 20 generates a grid or array, and projects the ambisonic content to the grid. The projected ambisonic content is transmitted from the content processor 20 to the panning processor 21 for further processing at Block 407. If at Block 402, the audio content is determined not to be ambisonic content, then the content processor 20 sends the audio content directly to the panning processor 21 for further processing at Block 407.

The method 400 also has a parallel path that is performed in Blocks 404-406, which results in the gains that are assigned to the real loudspeakers (and that will be applied to the audio content being panned.) At Block 404, the virtual loudspeaker placer 22 included in the panning processor 21 determines the placement of one or two placed virtual loudspeakers within the loudspeaker setup based on the positions of the real loudspeakers in the loudspeaker setup. The loudspeaker setup may include a number of real loudspeakers $3_1$-$3_n$ in an arbitrary loudspeaker setup. For example, the loudspeaker setup may be a 2-channel setup (e.g., a stereo pair) as shown in FIG. 3A, a 2D setup with more than two real loudspeakers such as a 5-channel setup as shown in FIG. 3B, and a 3D setup such as 13-channel setup as shown in FIG. 3C. At Block 405, gain redistributor 23 included in the panning processor 21 determines the VBAP gains that include gains assigned to the real loudspeakers and to the placed one or two virtual loudspeakers, and at Block 406, the gain redistributor 23 then redistributes the gains of the one or two placed virtual loudspeakers to the real loudspeakers to ensure preservation of total energy. At Block 407, the panning processor 21 applies the redistributed gains to the audio content which generates and transmits loudspeaker outputs to the real loudspeakers $3_1$-$3_n$ in the loudspeaker setup. In this aspect, the real loudspeakers in the loudspeaker setup have (or are assigned) the redistributed gains of the one or two placed virtual loudspeakers. If there is ambisonic content, then in Block 407 the redistributed gains are applied to the projected ambisonic content from Block 403 (thereby generating loudspeaker outputs in which the projected ambisonic content has been modified in accordance with the redistributed gains.)

An aspect of the disclosure is a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other aspects, some of these operations might be performed by specific hardware components that contain hardwired logic. Those operations might alternatively be performed by any combination of programmable computer components and fixed hardware circuit components.

While the disclosure here has been described in terms of several aspects, those of ordinary skill in the art will recognize that the disclosure is not limited to the aspects described, but can be practiced with modification and alteration within the spirit and scope of the appended claims. The description is thus to be regarded as illustrative instead of limiting. There are numerous other variations to different aspects described above, which in the interest of conciseness have not been provided in detail. Accordingly, other aspects are within the scope of the claims.

What is claimed is:

1. A method of performing panning for an arbitrary loudspeaker setup, comprising:

determining by a programmed processor a placement of one or two virtual loudspeakers within a loudspeaker setup, wherein the loudspeaker setup also refers to a plurality of real loudspeakers, wherein the determining comprises one of a) when the loudspeaker setup is a 2-channel setup, determining locations of the two virtual loudspeakers based on a center of a line formed by locations of two real loudspeakers in the loudspeaker setup and a listening position, b) when the loudspeaker setup is a 2-dimensional (2D) setup that refers to more than two real loudspeakers, determining the locations of the two virtual loudspeakers based on a centroid of a polygon formed by locations of real loudspeakers and the listening position, or c) when the loudspeaker setup is a 3-dimensional (3D) setup, determining the location of the one virtual loudspeaker based on a center of gravity of a polyhedron formed by the positions of the real loudspeakers;

determining a location of a panned sound source;

determining by the programmed processor, vector base amplitude panning (VBAP) gains based on the location of the panned source, wherein the VBAP gains include gains of the real loudspeakers and of the one or two virtual loudspeakers; and generating loudspeaker outputs for driving the real loudspeakers in the loudspeaker setup based on the determined VBAP gains and based on audio content to be output by the real loudspeakers.

2. The method of claim 1, wherein determining a placement of the one or two virtual loudspeakers within the loudspeaker setup, when the loudspeaker setup is the 2-channel setup, comprises:

determining the center of the line formed by the locations of the two real loudspeakers in the loudspeaker setup, determining an additive inverse of the center of the line formed by the locations of the two real loudspeakers, determining a line that is orthogonal to a plane formed by the locations of the two real loudspeakers and the listening position and that passes through the additive inverse, and determining intersection points between the line orthogonal to the plane and a unit sphere centered at the listening position, wherein the intersection points are the placement of the two virtual loudspeakers, respectively.

3. The method of claim 1, wherein determining a placement of the one or two virtual loudspeakers within the loudspeaker setup, when the loudspeaker setup is the 2D setup including more than two real loudspeakers, comprises:

forming the polygon with locations of the more than two real loudspeakers in the loudspeaker setup, determining the centroid of the polygon, determining an additive inverse of the centroid of the polygon, determining a line orthogonal to a polygon plane that passes through the additive inverse, and determining intersection points between the line and a unit sphere centered at the listening position, wherein the intersection points are the placement of two virtual loudspeakers, respectively.

4. The method of claim 1, wherein determining a placement of the one or two virtual loudspeakers within the loudspeaker setup, when the loudspeaker setup is the 3D setup, comprises:

forming the polyhedron with locations of the real loudspeakers in the loudspeaker setup, determining a centroid, wherein the centroid is the center of mass of the polyhedron, determining an anti-centroid, wherein the anti-centroid is an additive inverse of the centroid, wherein, when the centroid is at an origin, determining that no placement of the one or two virtual loudspeakers is needed in the loudspeaker setup, wherein, when the centroid is not at the origin, determining a line that includes the centroid and the anti-centroid, determining intersection points of the line and a unit sphere centered at the listening point, wherein one of the intersection points having a smallest distance to the anti-centroid is the placement of the one virtual loudspeaker.

5. The method of claim 1, further comprising:

redistributing gains of the one or two virtual loudspeakers to the real loudspeakers wherein the redistributed gains preserve total energy, by determining a quadratic formula based on the location of the panned sound source, and solving the quadratic formula to obtain a redistribution of gains, wherein the real loudspeakers playing back the loudspeaker outputs have the redistributed gains of the one or two virtual loudspeakers.

6. A method of performing panning for an arbitrary loudspeaker setup, comprising:

determining by a programmed processor a placement of one or two virtual loudspeakers within the loudspeaker setup, wherein the loudspeaker setup includes a plurality of real loudspeakers;

determining by the programmed processor vector base amplitude panning (VBAP) gains, wherein the VBAP gains include gains of the real loudspeakers and the one or two virtual loudspeakers;

redistributing by the programmed processor gains of the one or two virtual loudspeakers to the real loudspeakers wherein the gains are redistributed in way that preserves total energy of an intended sound field or recorded sound field of audio content to be output by the real loudspeakers, by determining a location of a panned sound source, determining a quadratic formula based on the location of the panned sound source, and solving the quadratic formula to obtain a redistribution of gains needed to ensure preservation of total energy; and generating based on the audio content loudspeaker outputs for the real loudspeakers, wherein the generated loudspeaker outputs for the real loudspeakers have the redistributed gains of the one or two virtual loudspeakers.

7. A method of performing panning for an arbitrary loudspeaker setup, comprising:

receiving audio content for playback via a plurality of real loudspeakers in the loudspeaker setup;

determining whether the audio content is Higher Order Ambisonics (HOA) content;

when the audio content is HOA content, generating by a programmed processor a virtual loudspeaker array including a plurality of virtual loudspeakers and projecting the HOA content to the virtual loudspeaker array;

determining a placement of one or two placed virtual loudspeakers within the loudspeaker setup, wherein the loudspeaker setup includes a plurality of real loudspeakers;

determining vector base amplitude panning (VBAP) gains, wherein the VBAP gains include gains of the real loudspeakers and the placed one or two virtual loudspeakers;

redistributing the gains of the one or two placed virtual loudspeakers to the real loudspeakers wherein the gains are redistributed in way that preserves total energy of an intended sound field or recorded sound field of audio content to be output by the real loudspeakers by i) determining a location of a panned sound source, determining a quadratic formula based on the location of the panned sound source, and solving the quadratic formula to obtain a redistribution of gains; and generating loudspeaker outputs for the real loudspeakers in the loudspeaker setup to be played back, wherein the real loudspeakers in the loudspeaker setup have the redistributed gains of the one or two placed virtual loudspeakers.

8. The method of claim 7, wherein the real loudspeakers playback the loudspeaker outputs that include the projected HOA content when the audio content is HOA content.

9. The method of claim 7, wherein generating the virtual loudspeaker array including a plurality of virtual loudspeakers and projecting the HOA content to the virtual loudspeaker array further comprises:

generating the virtual loudspeaker array using a spherical t-design, and positioning the virtual loudspeakers on a surface of a sphere of the spherical t-design, wherein the virtual loudspeakers are uniformly distributed on the surface of the sphere.

10. The method of claim 7, wherein when the loudspeaker setup is a 2-channel setup, locations of the two placed virtual loudspeakers are based on a center of a line formed by locations of two real loudspeakers included in the loudspeaker setup and a listening position, when the loudspeaker setup is a 2-dimensional (2D) setup including more than two real loudspeakers, the locations of the two placed virtual loudspeakers are based on a centroid of a polygon formed by locations of real loudspeakers and the listening position, and/or when the loudspeaker setup is a 3-dimensional (3D) setup, the location of the one placed virtual loudspeaker is based on a center of gravity of a polyhedron formed by the positions of the real loudspeakers.

11. The method of claim 10, wherein determining the placement of the one or two placed virtual loudspeakers within the loudspeaker setup, when the loudspeaker setup is the 2-channel setup, includes:

determining the center of the line formed by the locations of the two real loudspeakers in the loudspeaker setup, determining an additive inverse of the center of the line formed by the locations of the two real loudspeakers, determining a line orthogonal to a plane formed by the locations of the two real loudspeakers and the listening position through the additive inverse, and determining intersection points between the line orthogonal to the plane and a unit sphere centered at the listening position, wherein the intersection points are the placement of the two placed virtual loudspeakers, respectively.

12. The method of claim 10, wherein determining the placement of the one or two placed virtual loudspeakers within the loudspeaker setup, when the loudspeaker setup is the 2D setup including more than two real loudspeakers, includes:

forming the polygon with locations of the more than two real loudspeakers in the loudspeaker setup, determining the centroid of the polygon, determining an additive inverse of the centroid of the polygon, determining a line orthogonal to a polygon plane that passes through the additive inverse, and determining intersection points between the line and a unit sphere centered at the listening position, wherein the intersection points are the placement of two placed virtual loudspeakers, respectively.

13. The method of claim 10, wherein determining the placement of the one or two placed virtual loudspeakers within the loudspeaker setup, when the loudspeaker setup is the 3D setup, includes:

forming the polyhedron with locations of the real loudspeakers in the loudspeaker setup, determining a centroid, wherein the centroid is the center of mass of the polyhedron, determining an anti-centroid, wherein the anti-centroid is an additive inverse of the centroid, wherein, when the centroid is at an origin, determining that no placement of the one or two placed virtual loudspeakers is needed in the loudspeaker setup, wherein, when the centroid is not at the origin, determining a line that includes the centroid and the anti-centroid, determining intersection points of the line and a unit sphere centered at the listening point, wherein one of the intersection points having a smallest distance to the anti-centroid is the placement of the one placed virtual loudspeaker.

14. A system for performing panning for an arbitrary loudspeaker setup comprising:

a storage storing instructions; and a processor coupled to the storage, wherein the processor is to execute the instructions to:

receive audio content for playback via a plurality of real loudspeakers in the loudspeaker setup, determine a placement of one or two placed virtual loudspeakers within the loudspeaker setup, wherein the loudspeaker setup includes a plurality of real loudspeakers, determine vector base amplitude panning (VBAP) gains, wherein the VBAP gains include gains of the real loudspeakers and the one or two placed virtual loudspeakers, redistribute gains of the one or two placed virtual loudspeakers to the real loudspeakers wherein the gains are redistributed in way that preserves total energy of an intended sound field or recorded sound field of audio content to be output by the real loudspeakers, by i) determining a location of a panned sound source, determining a quadratic formula based on the location of the panned sound source, and solving the quadratic formula to obtain a redistribution of gains; and generate and transmit the loudspeaker outputs to be played back by the real loudspeakers based on the VBAP gains and based on the audio content, wherein the loudspeaker outputs have the redistributed gains of the one or two virtual loudspeakers.

15. The system of claim 14, wherein, when the processor executes the instructions, the processor is further to:

determine whether the audio content is Higher Order Ambisonics (HOA) content, and generate a virtual loudspeaker array including a plurality of virtual loudspeakers and projecting the HOA content to the virtual loudspeaker array when the processor determines that the audio content is HOA.

16. The system of claim 15, wherein the real loudspeakers playback the loudspeaker outputs that include the projected HOA content when the audio content is HOA content, wherein the real loudspeakers in the loudspeaker setup have the redistributed gains of the one or two placed virtual loudspeakers.

17. The system of claim 14 wherein the processor is to determine the placement of the virtual loudspeakers by one of a) when the loudspeaker setup is a 2-channel setup, determine the locations of the two virtual loudspeakers based on a center of a line formed by locations of two real loudspeakers in the loudspeaker setup and a listening position, b) when the loudspeaker setup is a 2-dimensional (2D) setup that refers to more than two real loudspeakers, determine the locations of the two virtual loudspeakers based on a centroid of a polygon formed by locations of real loudspeakers and the listening position, or c) when the loudspeaker setup is a 3-dimensional (3D) setup, determine the location of the one virtual loudspeaker based on a center of gravity of a polyhedron formed by the positions of the real loudspeakers.

* * * * *